US012077354B2

(12) United States Patent
Knobel et al.

(10) Patent No.: US 12,077,354 B2
(45) Date of Patent: Sep. 3, 2024

(54) CHILD RESISTANT CONTAINER HAVING INTEGRATED WINDOW

(71) Applicant: CR Packaging LLC, Allston, MA (US)

(72) Inventors: Simon Knobel, Vail, CO (US); Alexander Gonzalez, Brighton, MA (US)

(73) Assignee: CR Packaging LLC, Allston, MA (US)

( * ) Notice: Subject to any disclaimer, the term of this patent is extended or adjusted under 35 U.S.C. 154(b) by 0 days.

(21) Appl. No.: 17/771,943

(22) PCT Filed: Oct. 30, 2020

(86) PCT No.: PCT/US2020/058264
§ 371 (c)(1),
(2) Date: Apr. 26, 2022

(87) PCT Pub. No.: WO2021/087295
PCT Pub. Date: May 6, 2021

(65) Prior Publication Data

US 2022/0371794 A1 Nov. 24, 2022

Related U.S. Application Data

(60) Provisional application No. 62/928,089, filed on Oct. 30, 2019.

(51) Int. Cl.

| | |
|---|---|
| ***B65D 51/24*** | (2006.01) |
| ***B65D 21/02*** | (2006.01) |
| ***B65D 43/02*** | (2006.01) |

(52) U.S. Cl.
CPC ..... *B65D 51/24* (2013.01); *B65D 21/0223* (2013.01); *B65D 43/0212* (2013.01); *B65D 2543/00101* (2013.01); *B65D 2543/00296* (2013.01); *B65D 2543/00351* (2013.01); *B65D 2543/00527* (2013.01);
(Continued)

(58) Field of Classification Search
CPC ..... B65D 21/0223; B65D 43/0212; G02B 25/002
See application file for complete search history.

(56) References Cited

U.S. PATENT DOCUMENTS 3,812,342 A 5/1974 McNamara, Jr.
5,400,915 A * 3/1995 Kennedy ..... B65D 43/0222 215/230

(Continued)

OTHER PUBLICATIONS

What is FEP, (Holscot Europe), retrieved from URL:https://web.archive.org/web/20160906085941/https//www.holscoteurope.com/en/feb-2, Sep. 6, 2016.

(Continued)

*Primary Examiner* — Jeffrey R Allen
(74) *Attorney, Agent, or Firm* — Fox Rothschild LLP

(57) ABSTRACT

Disclosed herein are child-resistant containers having an integrated window. The containers have a container base and a container cap. The container cap contains the integrated window so that a user can view the contents stored within the container. The window can be any transparent, semi-transparent or translucent material. The material can control one or more environmental conditions, such as temperature, humidity, oxygen, ultra-violet light and others.

17 Claims, 5 Drawing Sheets

(52) U.S. Cl.
CPC ..... *B65D 2543/00537* (2013.01); *B65D 2543/0074* (2013.01); *B65D 2543/00814* (2013.01)

(56) References Cited

U.S. PATENT DOCUMENTS

| | | | | |
|---|---|---|---|---|
| 5,760,975 | A * | 6/1998 | DiGiovanni | B65D 51/24 359/802 |
| 2007/0078119 | A1 | 4/2007 | Purro et al. | |
| 2008/0314786 | A1 | 12/2008 | Wang et al. | |
| 2017/0139216 | A1 | 5/2017 | Crenko | |
| 2017/0190482 | A1* | 7/2017 | Smith | B65D 51/24 |
| 2019/0233184 | A1* | 8/2019 | Arminak | B65D 51/245 |

OTHER PUBLICATIONS

Koros et al., Oxygen Permeation Through FEP Teflon and Kapton Polyimide, retrieved from https://onlinelibrary.wiley.com/doi/pdf/10.1002/app.1981.

International Search Report and the Written Opinion from Corresponding PCT Application No. PCT/US2020/058264, dated Feb. 4, 2021, 9 pages.

* cited by examiner

600

CHILD RESISTANT CONTAINER HAVING INTEGRATED WINDOW

CROSS-REFERENCE TO RELATED APPLICATION

This application is a National Stage Application filed under 35 U.S.C. § 371, of International Patent Application No. PCT/US2020/058264, filed Oct. 30, 2020, which claims the benefit of and priority to U.S. Provisional Application No. 62/928,089, filed Oct. 30, 2019. The entire contents of which are hereby incorporated by reference in their entirety.

TECHNICAL FIELD

The present disclosure relates to a child resistant container having an integrated window, for viewing objects within the container.

BACKGROUND

Containers intended for storing substances or materials which may be harmful to children are designed to prevent opening by a child and yet can be manipulated by adults, including seniors, to gain access to the substance. These "child-resistant" containers are typically used for over the counter and prescription medications. Other child-resistant containers are used for other household items, that are toxic if swallowed or ingested, such as laundry detergent and cleaners. These systems are in place to prevent children from inadvertently gaining access to the contents of these containers.

Generally, child resistant containers include a multi-step opening process or require steps to be completed simultaneously. A certain level of mental and physical dexterity is required for opening such a container, making it difficult for children to access the contents within. For example, use of a certain amount of pressure or force while a second action is completed is needed to open such a container, which prevents children from being able to open and access the contents of the container.

A challenge in creating child resistant containers is making the container easy enough for the elderly and other individuals to be able to use. For example, some child resistant containers offer a screw-cap or pop-top closure, and although they are efficient for child resistance, these devices pose a degree of hardship for individuals with wrist and finger joint inflammation or arthritis.

Currently available child resistant containers are also often inadequate in protecting the contents from degradation upon exposure to environmental factors such as moisture, temperature, bacteria or air.

Also, most screw cap medicine containers lack external features favorable for viewing objects or materials stored within the container.

Therefore, there remains a need for improved containers and systems that are easy to use for an elderly or disabled individual, while providing child-resistant features. Also, there remains a need for a container where the contents are protected for improved shelf-life, by controlling environmental factors, such as being liquid-tight, air-tight, or both. Finally, there remains a need for containers that have an integrated window so that the contents of the containers can be easily viewed and inspected.

SUMMARY

The present invention relates to a container having an integrated window for viewing objects within the container.

Embodiments of the containers are configured to be child-resistant. The disclosed containers provide improved packaging and storage of substances or materials in a controlled environment, providing, for example, an air-tight, liquid-tight, water-tight, humidity-controlled, light-controlled, or any combination thereof, environment.

Accordingly, in one aspect, the present invention is directed to a child-resistant container having a base and a lid or a cap. The container cap comprises a closed top end and an open bottom end. The closed top end comprises a window substantially flush with an elevated portion of the closed top end.

In one aspect, the window in the container cap comprises a magnifying lens. The magnifying lens comprises a flat top surface and a convex bottom surface, the flat top surface is substantially flush with the elevated portion of the cap.

In another aspect, the magnifying lens is received in the elevated portion.

In some aspects, the magnifying lens further comprises a flange that engages with the elevated portion. In one aspect, the flange radially extends around a side of the magnifying lens.

In some aspects, the magnifying lens provides at least 1× magnification. For example, the magnifying lens provides about 1.5× to about 5× magnification.

In some aspects, a focal length of the magnifying lens is about 50 mm to about 200 mm. In one aspect, the focal length of the magnifying lens is about 100 mm to about 150 mm.

In one aspect, the window in the container cap comprises a transparent film. In one aspect, the transparent film comprises fluorinated ethylene propylene (FEP).

In some aspects. the film is configured to diffuse oxygen, water vapor, or a combination thereof. In some aspects, the film is configured to substantially block ultra-violet (UV) radiation.

In some aspects, the container cap further comprises an annular sealing ring positioned on an inner surface of the closed top end of the container cap.

In one aspect, the container cap is substantially symmetrical in shape. In one aspect, the cap is substantially polygonal in shape. For example, the container cap is substantially square in shape. In some aspects, the container cap has rounded corners.

In some aspects, the container cap further comprises one or more ridges on each side of an interior surface of the container cap. Each of the one or more ridges forms one or more rows of ridges. In one aspect, the container cap comprises 4 or more rows of ridges, wherein each row of ridges comprises at least one ridge.

In one aspect, the container cap is configured to attach to a base, wherein the cap attached to the base is child-resistant.

In some aspects, the cap further comprises a plastic, a polymer, or a combination thereof. For example, the plastic is selected from the group consisting of polypropylene, polyethylene, polystyrene, polycarbonate, acrylic, or a combination thereof.

BRIEF DESCRIPTION OF THE DRAWINGS

Features and advantages of the claimed subject matter will be apparent from the following description of embodiments consistent herewith, which the description should be considered in conjunction with the accompanying drawings.

DETAILED DESCRIPTION OF THE INVENTION

Figure 1:
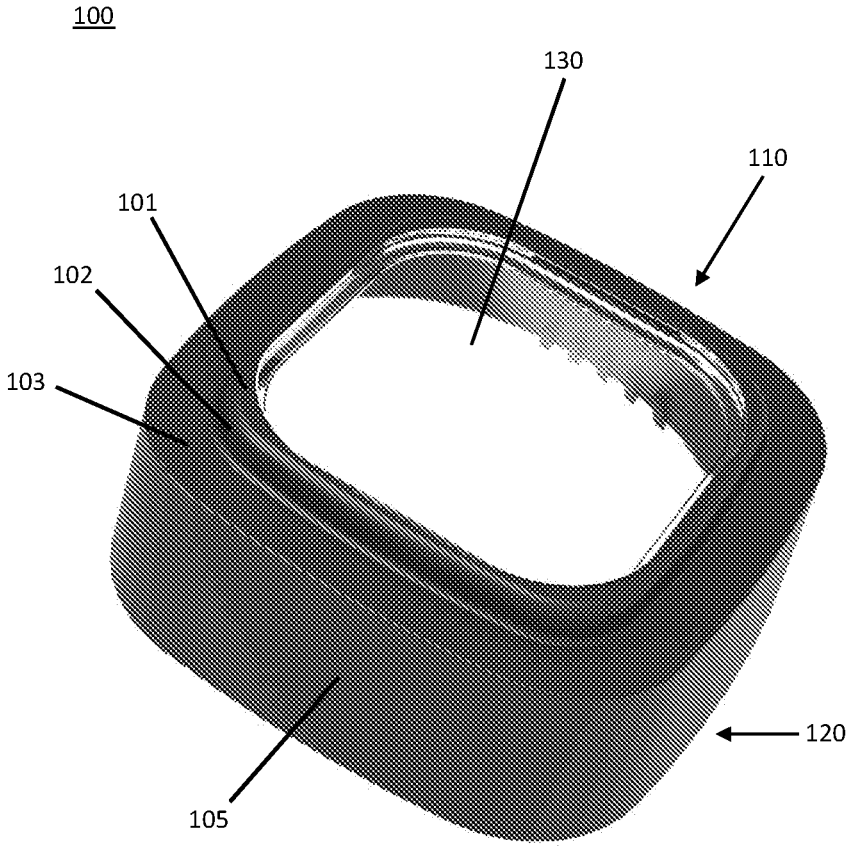
FIG. 1 illustrates a top perspective view of an embodiment of a container cap having an integrated window.
Figure 2:
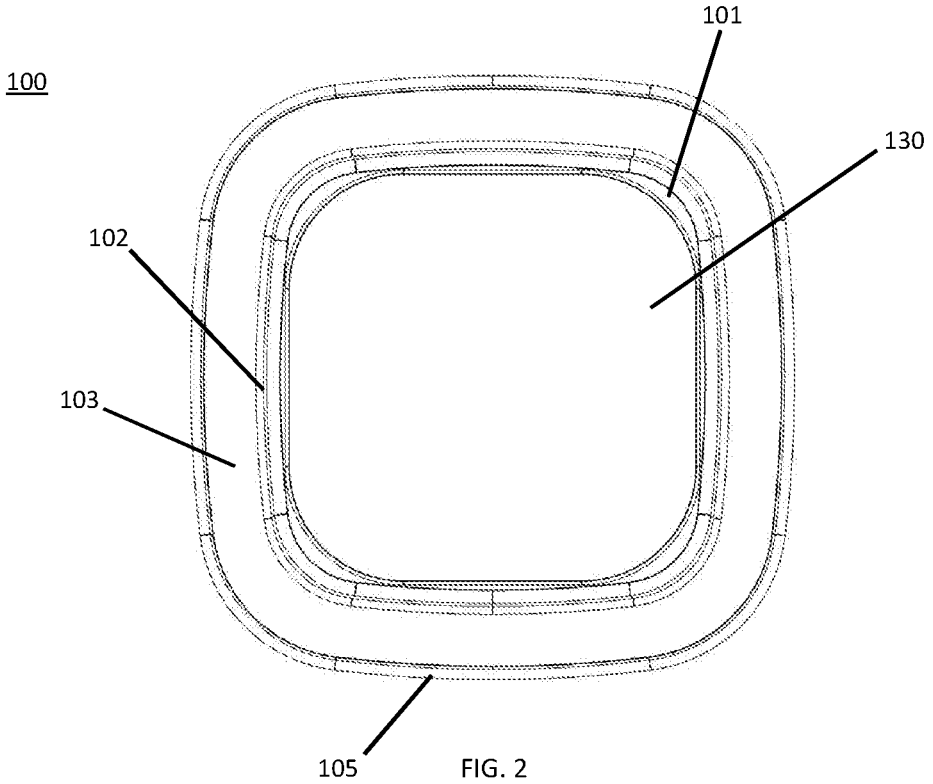
FIG. 2 illustrates a top view of the embodiment of a container cap of FIG. 1.
Figure 3:
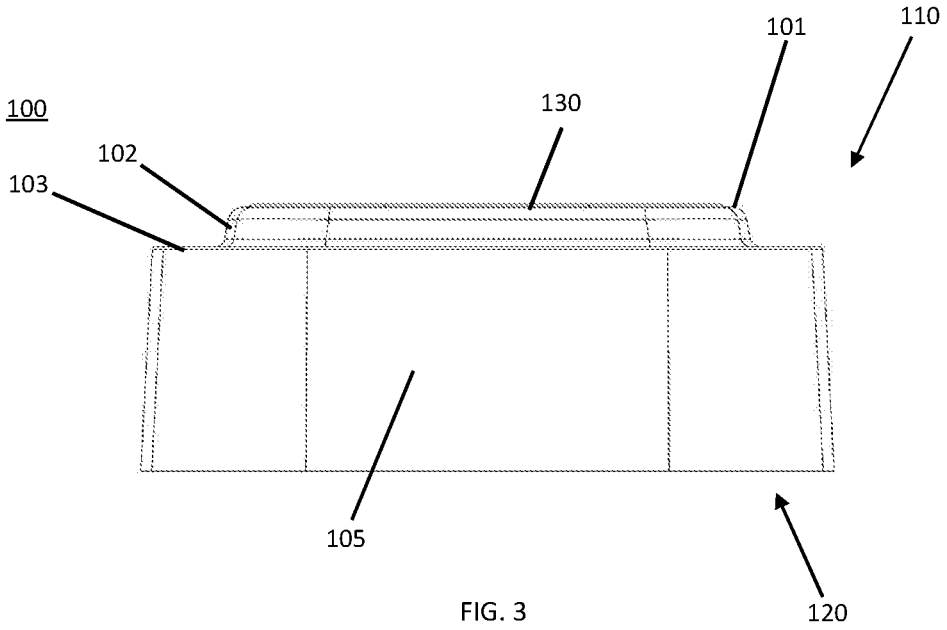
FIG. 3 illustrates a side view of the embodiment of a container cap of FIG. 1.
Figure 4:
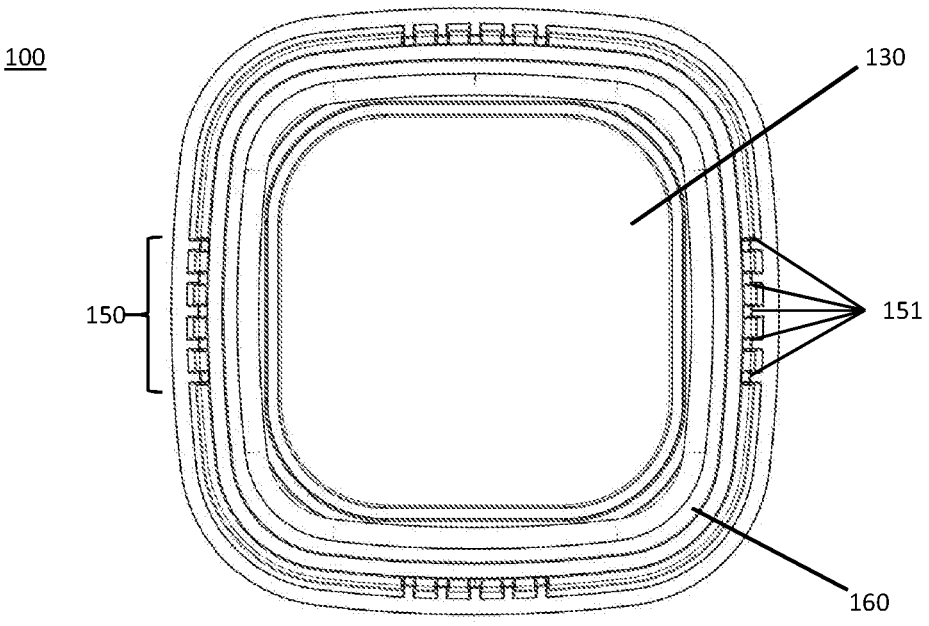
FIG. 4 illustrates a bottom view of the embodiment of a container cap of FIG. 1.

The present invention relates to child-resistant containers. Aspects of present disclosure also include containers having a window integrated in or as part of the container. Other aspects include integrated windows that include, for example, a magnifying lens and transparent films. The container can be understood more readily by reference to the following detailed description of the invention. It will be apparent to those skilled in the art that various modifications can be made without departing from the scope of the invention.

As used in the specification and the appended claims, the singular forms "a," "an" and "the" include plural referents unless the context clearly dictates otherwise. Thus, for example, reference to "an element" includes two or more elements.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including matters of logic with respect to arrangement of steps or operational flow; plain meaning derived from grammatical organization or punctuation; and the number or type of aspects described in the specification.

It is understood that the containers, materials and devices disclosed herein have certain functions. Disclosed herein are certain structural requirements for performing the disclosed functions, and it is understood that there are a variety of structures that can perform the same function that are related to the disclosed structures, and that these structures will typically achieve the same result.

One aspect of the present disclosure is a child-resistant container having an integrated window. The child-resistant containers are configured to store, hold and/or preserve a substance or a material as well as providing a mechanism for child-resistance.

Generally, the child-resistant containers described herein comprise a container base and a container cap. When the container is in a closed configuration, the base is engaged with the cap. In a closed configuration, the container is substantially child-resistant, that is, a child would have a difficult time removing the container cap from the container base.

The container base has a closed bottom end, an open top end and an outer surface. Embodiments of the container, including the container base and cap, are substantially symmetrical in shape.

The container base can have markings on one or more sides of the container. The marking can be used for gripping the container base and/or distinguish one side of the container from another side. The markings can be, for example, slightly raised from the outer surface of the container base. A user squeezes or presses inwardly at the positions of the markings, simultaneously pulling upward the container cap, to remove the container cap from the container base.

A radially extending flange is part of container base. The flange structurally separates the container base into a lower body and an upper neck. The flange is positioned near and parallel to the top end of container base. The flange adds to the child-resistance of the container (e.g., to prevent children from getting under the cap and using nails/teeth to pry open). The flange structure and force ratio maintenance around that specific area of the container cap to diffuse squeeze force equally, and to separate cap and base, and it also prevents the cap from over compressing the seal. The combination of the forces of the flange and the retention features create the right amount of compression.

The container cap has an outer surface and an inner surface. The container cap also has an open bottom end (a receiving end for the container base) and a closed top end. On the top end of the container cap, there is a shoulder, a ramp, and elevated portion. The shoulder, ramp and elevated portion allow for stacking a container base on top of the container cap (e.g., containers are self-stacking), and allow for a tray insert or tray frame to stack on top of the container cap. The container cap can have markings on the inner surface and/or outer surface.

Figure 5:
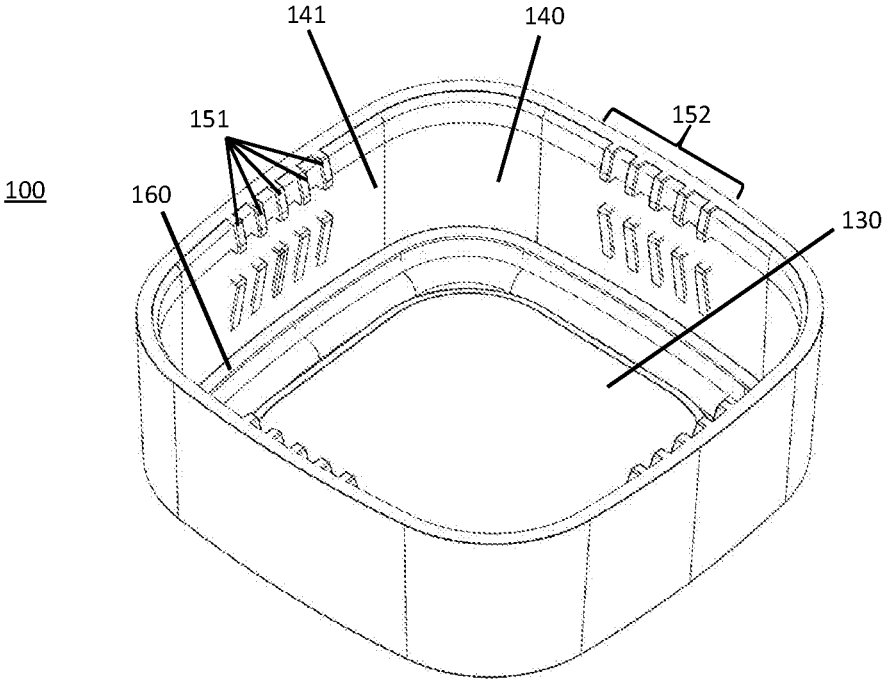
FIG. 5 illustrates a bottom perspective view of the embodiment of a container cap of FIG. 1.

The container cap can have an annular seal (e.g., an O-ring or gasket) in the inner surface at or near the top end of the cap as shown in FIG. 5. The annular seal can help provide a barrier between the container environment and the external environment. Materials being stored in the container may be sensitive to air, water, oxygen, light, UV, temperature, bacteria, or combinations thereof.

The container cap has one or more base engagement elements. Each of the base engagement elements are positioned on the inner surface of container cap, e.g., on some or all sides of container cap. Each base engagement element comprises one or more rows of ridges, where each row has a one or more (e.g., 1, 2, 3, 4, 5, 6, 7, 8, 9, 10 or more) of ridges.

In other words, the ridges can be arranged as a row of ridges. The ridges on the cap can be positioned as to form an upper row and a lower row of ridges. There is a space or gap between the upper row and lower row of ridges. The ridges are sized and shaped so as to engage with a cap engagement element on a container base. In some instances, the ridges are slightly ramped. The ridges are sized and configured to slide and fit into a groove of a cap engagement element.

The child-resistant features of the container relate to the engagement of the container base with the container cap. One or more cap engagement elements are part of the container base. The cap engagement element is made up of a raised surface or ledge. The raised surface is positioned near and parallel to the top end of container base. Just above a radially extending flange and below the raised surface are longitudinally extending ridges or ramps. The ridges extend from at or near the raised surface to the flange. A groove is formed between two ridges (i.e., the space between the ridges is the groove). The ridges and groove provide guidance and alignment of the container cap in addition to providing a tight fit with the container base. The cap engagement element prevents a container cap from easily being taken off the container base or removed improperly. Generally, a cap engagement element is position on two, opposite sides of the container base. However, a single cap engagement element can be on the container base (e.g., for a tube container), or 3 or more cap engagement elements be on the container base.

A window is integrated in the cap so that the contents of the container can be viewed. The window sits substantially flush with the top end of the cap, for example, the elevated portion. The window, for example, is any transparent, semi-transparent or translucent material to allow for viewing, such as plastics, films, and glass. Examples of transparent materials include acrylic and polycarbonate.

Enhanced viewing is achieved with integration of a magnifying lens as part of the window. The magnifying lens can provide at least 1.1× magnification, such as 1.1×, 1.2×, 1.3×, 1.4×, 1.5×, 1.6×, 1.7×, 1.8×, 1.9×, 2.0×, 2.5×, 3.0×, 3.5×, 4.0×, 4.5×, 5.0×, 6.0×, 7.0×, 8.0×, 9.0×, 10.0×, or more than 10.0× magnification.

The containers described herein are stackable on itself and have features to make them child resistant. Other features will be readily apparent in light of the foregoing.

FIGS. 1-5 illustrate a container cap 100 having an integrated window for a child-resistant container. Examples of child-resistant containers are disclosed in U.S. Pat. No. 10,376,445 and 10,383,793, which are incorporated by reference in their entirety.

Container cap 100 has a closed top end 110 and an open bottom end 120 for receiving a container base (not shown). Cap 100, at closed top end 110, has an elevated portion 101, ramp 102 and shoulder 103. Elevated portion 101, ramp 102, and shoulder 103 are sized and configured to receive a bottom end of a container base, for self-stacking. Cap 100 has four sides 105 and forms a generally square shape.

Container cap 100 has an annular sealing ring or gasket 160 positioned on an inner surface of closed top end 110 of container cap 100.

Container cap 100 is substantially symmetrical in shape. Cap 100 is substantially polygonal in shape. For example, container cap 100 is substantially square in shape and has rounded corners.

Within and integrated with closed top end 110 is window 130. Window 130 is sized and shaped in any number of configurations. Elevated portion 101 of top end 110 is configured to receive window 130. As illustrated in FIGS. 1-5, window 130 is positioned within elevated portion 101 and sits substantially flush with top end 110. Window 130 can be permanently affixed to closed top end 110 or removably affixed. Any transparent, semi-transparent or translucent material can be used to form window 130, such as, for example, plastic, glass, films, polymers and fabrics. Window 130 can form substantially or entirely the elevated portion 101. Window 130 can be sized larger or smaller and positioned anywhere on cap 100.

Cap 100 has interior surface 140, forming sides 141. Positioned on each side 141 is a base engagement element 150. Base engagement element 150 has one or more ridges 151. For example, 1, 2, 3 4, 5, 6, 7, 8, 9, 10 or more ridges can form a row of ridges 152 of base engagement element 150. Base engagement element 150 can be formed by 1, 2, 3 or more rows of ridges 152. As illustrated in FIG. 5, base engagement element 150 has two rows of ridges 152, with each row having five ridges 151. Container cap 100 has a total of eight rows of ridges 152, with two rows positioned on each side 141.

Figure 6:
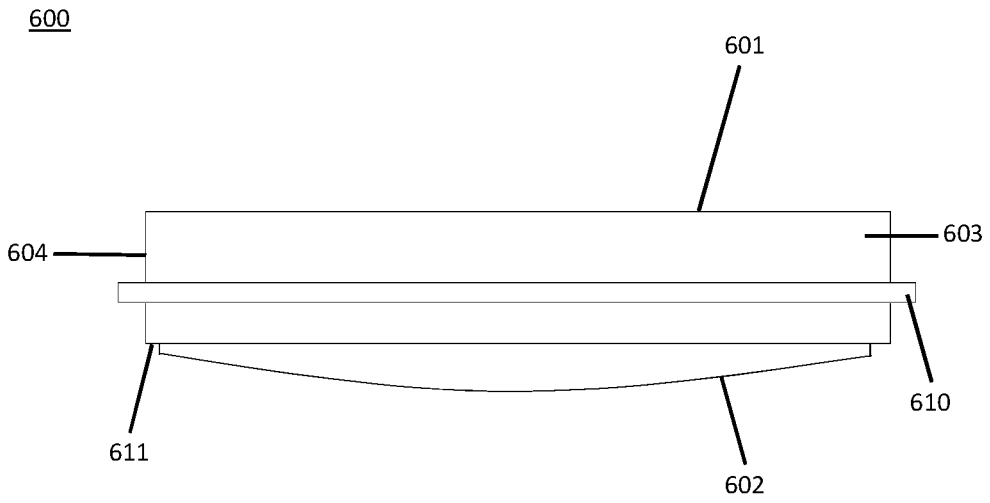
FIG. 6 illustrates a side view of an embodiment of a magnifying lens.
Figure 7:
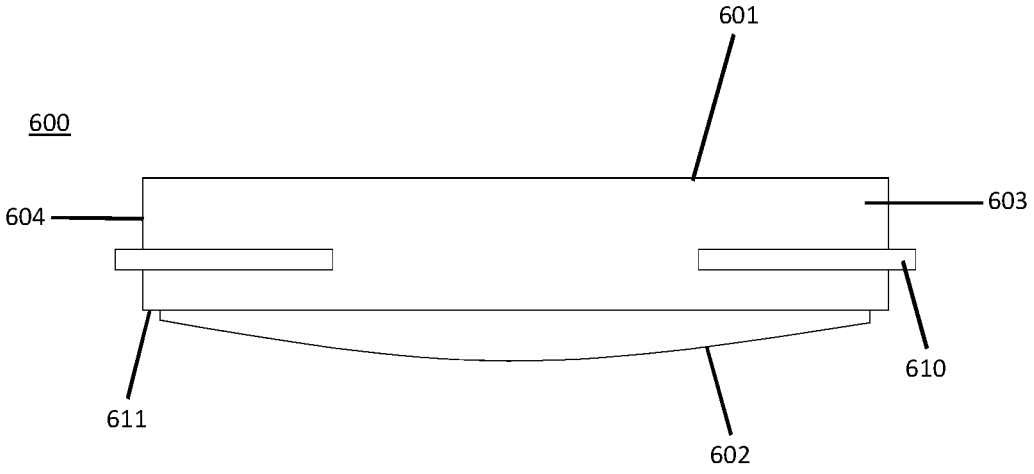
FIG. 7 illustrates another side view of the embodiment of the magnifying lens of FIG. 6.
Figure 8:
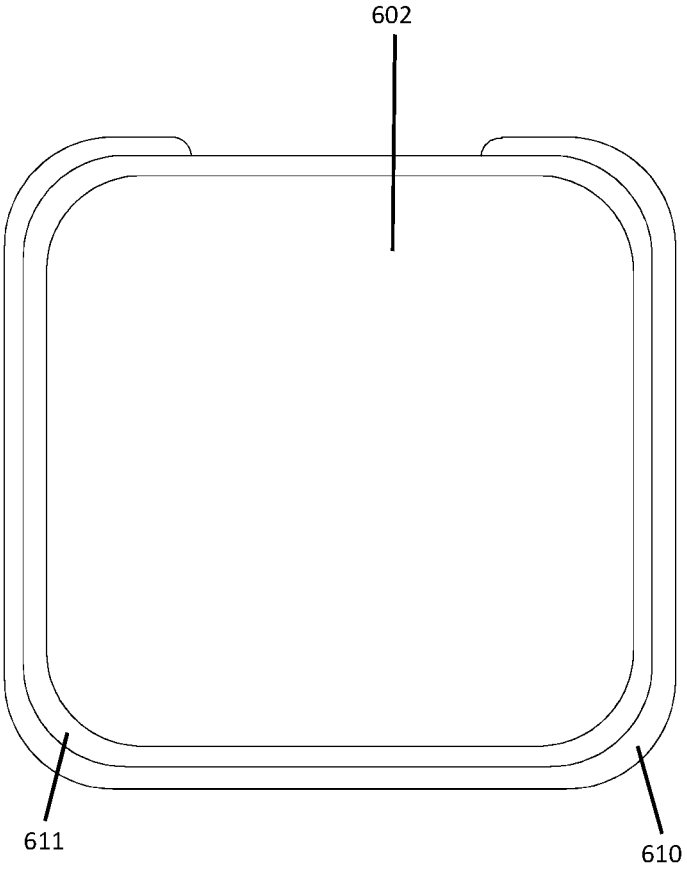
FIG. 8 illustrates a bottom view of the embodiment of the magnifying lens of FIG. 6.

Referring to FIGS. 6-8, magnifying lens 600 can form window 130. Magnifying lens 600 has flat top surface 601, convex bottom surface 602 and body 603. Ledge 611 sits where convex bottom surface 602 connects to body 603. Extending from side 604 is flange 610. Disposed partially or completely around body 603, flange 610 helps secure lens 600 to top end of cap 110. Top surface 601 is substantially flush with top end 110 of cap 100. A groove within the top end of the cap (not shown) is sized and configured to receive flange 610 to snap-fit within the cap. Additional adhesives, glues, tapes, bonds, and/or fasteners can be used to permanently or non-permanently secure lens 600.

Magnification lens 600 provides at least 1× magnification. For example, the magnifying lens provides about 1× to about 10× magnification. The magnification lens provides about 1.1×, 1.2×, 1.3×, 1.4×, 1.5×, 1.6×, 1.7×, 1.8×, 1.9×, 2.0×, 2.5×, 3.0×, 3.5×, 4.0×, 4.5×, 5.0×, 6.0×, 7.0×, 8.0×, 9.0×, 10.0×, or more than 10.0× magnification.

The focal length of the magnifying lens is about 10 mm to about 300 mm or about 50 mm to about 200 mm. In one aspect, the focal length of the magnifying lens is about 100 mm to about 150 mm.

Window 130 can be formed from a film. The film can be transparent, semi-transparent, or translucent. The film is configured to diffuse oxygen, water vapor, or a combination thereof. The film can also be configured to substantially block ultra-violet (UV) radiation. For example, the film can comprise fluorinated ethylene propylene (FEP).

The caps disclosed herein are configured to attach to a base, wherein the cap attached to the base forms a child-resistant container.

The caps disclosed herein are formed from any suitable material. For example, the cap comprises a plastic, a polymer, paper-based material, recycled material, glass, metal, metal-alloy, or a combination thereof. For example, the plastic is selected from the group consisting of polypropylene, polypropylene copolymer, ultra-clarified polypropylene, colored polypropylene, polyethylene, polystyrene, polycarbonate, acrylic, polyvinyl chloride, PET, acrylic, or a combination thereof.

The plastic can be injection molded, thermoformed, vacuum formed, or manufactured in any way suitable to make the components described herein to achieve the desired functionality.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A container cap for a child-resistant container comprising:

a closed top end; and an open bottom end, wherein the closed top end comprises a window substantially flush with an elevated portion of the closed top end, wherein the window comprises a magnifying lens, wherein the magnifying lens comprises a flat top surface, a convex bottom surface, and a flange, and wherein the magnifying lens is received in the elevated portion and the flange is configured to fit within a groove in the closed top end so that the flat top surface is substantially flush with the elevated portion.

2. The container cap of claim 1, wherein the flange radially extends around a side of the magnifying lens.

3. The container cap of claim 2, wherein the magnifying lens provides at least 1× magnification.

4. The container cap of claim 3, wherein the magnifying lens provides about 1.5× to about 5× magnification.

5. The container cap of claim 4, wherein a focal length of the magnifying lens is about 50 mm to about 200 mm.

6. The container cap of claim 1, wherein the window comprises a transparent, semi-transparent or translucent film.

7. The container cap of claim 6, wherein the film comprises fluorinated ethylene propylene (FEP).

8. The container cap of claim 1, further comprising an annular sealing ring positioned on an inner surface of the closed top end of the container cap.

9. The container cap of claim 1, wherein the cap is substantially symmetrical in shape.

10. The container cap of claim 1, wherein the cap is substantially polygonal in shape.

11. The container cap of claim 1, wherein the cap is substantially square in shape.

12. The container cap of claim 1, wherein the cap has rounded corners.

13. The container cap of claim 1, further comprising one or more ridges on each side of an interior surface of the container cap.

14. The container cap of claim 13, wherein each of the one or more ridges forms one or more rows of ridges.

15. The container cap of claim 14, further comprising 4 or more rows of ridges, wherein each row of ridges comprises at least one ridge.

16. The container cap of claim 1, wherein the cap is configured to attach to a base, and wherein the cap attached to the base forms the child-resistant container.

17. A container comprising:

a container cap of claim 1; and a base, wherein the cap attached to the base forms the child-resistant container.

* * * * *